US006971646B2

(12) United States Patent
Schmid

(10) Patent No.: US 6,971,646 B2
(45) Date of Patent: Dec. 6, 2005

(54) MODULE FOR TEMPORARILY STORING FLAT PRINTED PRODUCTS AND PRINTED PRODUCT FURTHER PROCESSING DEVICE

(75) Inventor: Frank Matthias Schmid, Krefel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 204 days.

(21) Appl. No.: 10/271,263

(22) Filed: Oct. 15, 2002

(65) Prior Publication Data

US 2003/0071410 A1 Apr. 17, 2003

(30) Foreign Application Priority Data

Oct. 15, 2001 (DE) ..... 101 50 849

(51) Int. Cl.[7] ..... B65H 29/26

(52) U.S. Cl. ..... 271/192; 271/189; 414/793.5; 414/794.2

(58) Field of Search ..... 271/192, 218, 271/189, 190; 414/793.5, 790.9, 794.2

(56) References Cited

U.S. PATENT DOCUMENTS

| | | | | |
|---|---|---|---|---|
| 2,010,732 A | * | 8/1935 | Mandusic | 414/793.7 |
| 3,306,609 A | * | 2/1967 | Beuck | 271/192 |
| 4,209,917 A | * | 7/1980 | Johnson | 34/612 |
| 4,460,169 A | * | 7/1984 | Bartesaghi | 271/192 |
| 4,562,650 A | * | 1/1986 | Nagasawa et al. | 34/612 |
| 4,684,118 A | | 8/1987 | Boss et al. | |
| 6,019,213 A | | 2/2000 | Schubert | |

FOREIGN PATENT DOCUMENTS

| | | | | |
|---|---|---|---|---|
| DE | 40 23 234 A1 | | 2/1991 | |
| DE | 41 24 943 A1 | | 1/1993 | |
| DE | 195 22 189 C2 | | 1/1997 | |
| EP | 0 359 727 A2 | | 3/1990 | |
| EP | 0 683 054 A2 | | 11/1995 | |
| EP | 683054 A2 | * | 11/1995 | ..... B41J 13/08 |
| WO | WO 99/32386 | | 7/1999 | |

* cited by examiner

*Primary Examiner*—Patrick Mackey
(74) *Attorney, Agent, or Firm*—Laurence A. Greenberg; Werner H. Stemer; Ralph E. Locher

(57) ABSTRACT

A module for temporarily storing a succession of flat printed products includes a first carrier element train on a first transport element assigned to a first side wall, and a second carrier element train on a second transport element assigned to a second side wall located opposite the first side wall. The transport elements are movable relative to the side walls and correlated with one another, for a form-locking, at least partial support of a printing product loaded into the module. Support for an underside of the loaded printing product is provided by upper sides of first and second carrier elements. Third and fourth carrier elements have respective undersides making form-locking contact with the upper side of the loaded printed product for holding down the underside of the loaded printed product on the upper sides of the first and second carrier elements. A further processing device includes the module.

15 Claims, 6 Drawing Sheets

MODULE FOR TEMPORARILY STORING FLAT PRINTED PRODUCTS AND PRINTED PRODUCT FURTHER PROCESSING DEVICE

BACKGROUND OF THE INVENTION

Field of the Invention

The invention relates to a module for temporarily storing a succession of flat printed products, including a first carrier element train on a first transport element assigned to a first side wall of the module, and a second carrier element train on a second transport element assigned to a second side wall of the module, which is located opposite the first side wall. The transport elements are movable relative to the side walls and correlated with one another, for form-lockingly, at least partly supporting a printing product, which has been loaded into the module. Support for the printing product is at an underside thereof by an upper side of the first carrier element train and by an upper side of the second carrier element of the second carrier element train. A form-locking connection is one which connects two elements together due to the shape of the elements themselves, as opposed to a force-locking connection, which locks the elements together by force external to the elements.

A final printed product, for example a periodical, a catalog, a brochure, a book or the like, is generally made up of a number of different signatures or flat printed products. It is customary for the signatures or flat printed products required for such final printed products to be produced in parallel or successively on printing presses, whether web-fed rotary presses or sheet-fed presses, typically offset presses, based upon available capacities, and to be stored temporarily before being processed in machines for further print processing, such as book-binding machines, stapling machines, thread-sealing machines, folders, mailroom machines and the like. Furthermore, signatures or flat printed products are frequently produced on presses at a location other than the location of the further printing machines, so that temporary storage that is also suitable for transport is required. Hereinafter, reference is made to flat printed products. What is meant thereby is signatures, whether flat sheets or flat folded sheets.

A large number of devices provided for the purpose of intermediate storage or temporary storage of flat printed products have become known heretofore from the prior art. Amongst others, the following different storage forms have become widespread:

For example, loose piles or stacks of signatures or flat products can be deposited in a staggered or offset manner on a pallet. This form of temporary storage is also referred to as storage in bricks or blocks, but is disadvantageously costly because of a relatively high use of personnel, and is therefore less suitable for industrial applications.

International Publication No. WO 99/32386 describes how a stream of flat printed products, after being divided up into longitudinal sections and having a carrier element fixed, can be picked up for temporary storage in a transport device, the lateral ends of the carrier element being able to be deposited on holding areas of the transport device. Although this type of storage permits a high storage density and entails relatively low investment costs, as well as avoids any bending of the flat printed products, storage in the form of flat printed products combined into blocks or bars leads to complicated devices, often requiring a large amount of installation space for removing the printing products from the temporary storage, in particular for removal thereof for loading into a further processing machine or a printed-product further processing device.

One type of temporary storage, generally associated with low expenditure for personnel and suitable for automatic removal, in particular for loading into a further processing machine, is a storage of signatures or flat printed products by winding them spirally onto a roller. A temporary storage device of this type is disclosed in U.S. Pat. No. 4,684,118. Flat printed products are stored from time to time or temporarily on a roller or rotor between two successive processing machines in a production line, for example, and a further processing machine, by the printed products being laid together with a flexible strip in a manner that the printed products come to lie between adjacent layers of the spirally wound strip and are held by a force from adjacent layers of the strip. A considerable disadvantage of storage in the form of a spirally wound roll is that a printed product, which is picked up initially and therefore lies on the inside, can be removed from the roll only after a printed product which is picked up later and therefore is lying on the outside. In addition to relatively high investment costs and a great requirement for space, it is disadvantageous that the flat printed products are accommodated in curved forms, above all, with different degrees of curvature, because the curvature increases with decreasing diameter of the loaded roll. As a result of the relatively great force (pressure) of the accommodating flexible strip, the flat printed products can cohere or stick to one another.

The published European Patent Application EP 0 359 727 discloses a method and a module for temporary storage of a succession of flat printed products, which are conveyed at least approximately horizontally in imbricated formation on a transport device, which comprises two trains of vertically moveable shelves as carrier elements. In the module, the trains of shelves, respectively, are held on a transport element and assigned, respectively, to a side wall of the module. The transport elements are movable relative to the side walls and in a manner correlated with one another. The upper side of a shelf in the first train and the upper side of a shelf in the second train-cooperate in the module in such a way that, at least to some extent, a form-locking support of the underside of a printed product loaded into the module or of the undersides of a section of a succession of printed products conveyed on the transport device is provided. Respectively, in cooperation between two shelves of the train of shelves, storage planes for sections of a succession of printed products are formed which, in comparison with the area defined by the transport device, are movable vertically. The module therefore is made up of a train or succession of storage planes which are arranged, at least approximately parallel to one another, above one another, and can be brought to the level of the transport device. The disclosed module for temporary storage is disadvantageously restricted to the described geometry: The stored flat printed products rest only on the shelves arranged at least approximately horizontally, i.e., can therefore change position if any deviation from the horizontal attitude of the shelves should occur. Furthermore, the disclosed module can be used only for flat printed products which, fixed by their inherent stiffness, bridge the gap between a shelf in the first train and a shelf in the second train.

SUMMARY OF THE INVENTION

It is accordingly an object of the invention to provide a module for temporarily storing flat printed products and a printed product further processing device, which overcomes the hereinafore-mentioned disadvantages of the heretofore-known devices of this general type and wherein the flat printed products are received singly separated and fixed in position, so that during transport of the module or during a change in the orientation of the module, a change in the position of the loaded flat printed products is avoided.

With the foregoing and other objects in view, there is provided, in accordance with the invention, a module for temporarily storing a succession of flat printed products, comprising a first carrier element train on a first transport element assigned to a first side wall of the module. A second carrier element train is on a second transport element assigned to a second side wall of the module. The second side wall is located opposite the first side wall. The transport elements are movable relative to the side walls and correlated with one another, for a form-locking, at least partial support of a printing product which has been loaded into the module. The support for the loaded printing product is at an underside thereof by an upper side of the first carrier element train and by an upper side of the second carrier element of the second carrier element train. A third carrier element of the first carrier element train and a fourth carrier element of the second carrier element train have respective undersides making form-locking contact with the upper side of the loaded printed product, so that the underside of the loaded printed product is held down on the upper sides of the first and the second carrier elements.

In accordance with another feature of the invention, the undersides of the third and the fourth carrier elements holding down the underside of the loaded printed product serve for exerting a force on the loaded printed product so that the latter is respectively gripped by the first and the third carrier elements and by the second and the fourth carrier elements.

In accordance with a further feature of the invention, the first and the second transport elements are respectively formed by a belt part. The carrier elements associated therewith are formed by teeth of a first and a second toothed belt.

In accordance with an added feature of the invention, the first toothed belt partly surrounds a first and a second deflection roller and the second toothed belt partly surrounds a third and a fourth deflection roller. The toothed belts have paths which, at least in some sections thereof, run at least approximately parallel to one another and at least approximately parallel to the side walls.

In accordance with an additional feature of the invention, a spaced distance between the first and the second deflection rollers and a spaced distance between the third and the fourth deflection rollers are variable in a manner correlated with one another in a direction of a sectional parallel course of the toothed belts.

In accordance with yet another feature of the invention, the first and the second side walls are spaced a variable distance from one another.

In accordance with yet a further feature of the invention, the module further includes at least one actuator provided for producing relative movement between the transport elements and the side walls.

In accordance with a further feature of the invention, when the module has no printed products loaded therein, a spaced distance between the first side wall and the second side wall can be reduced. Therefore, at least one partial surface of the first side wall can be brought into form-locking engagement with a partial surface of the second side wall and/or the teeth of the first toothed belt can be brought into form-locking engagement with the teeth of the second toothed belt.

With the objects of the invention in view, there is also provided a printed product further processing device having a feeder provided with a module for temporarily storing a succession of flat printed products. The device comprises a first carrier element train on a first transport element assigned to a first side wall of the module, and a second carrier element train on a second transport element assigned to a second side wall of the module. The second side wall is located opposite the first side wall. The transport elements are movable relative to the side walls and correlated with one another, for a form-locking, at least partial support of a printing product which has been loaded into the module. The support for the loaded printing product is at an underside thereof by an upper side of the first carrier element train and by an upper side of the second carrier element of the second carrier element train. A third carrier element of the first carrier element train and a fourth carrier element of the second carrier element train have respective undersides making form-locking contact with the upper side of the loaded printed product. Therefore, the underside of the loaded printed product is held down on the upper sides of the first and the second carrier elements.

In accordance with a concomitant feature of the invention, the printed product further processing device is selected from the group consisting of a gatherer-stitcher, an adhesive binder, a thread-sealing machine, a folder and a mailroom system.

Thus, a module according to the invention for temporary storage of a succession of flat printed products, comprises a first carrier element train on a first transport element which is assigned to a first side wall of the module, and a second carrier element train on a second transport element which is assigned to a second side wall of the module, opposite the first side wall, it being possible for the transport elements to be moved relative to the side walls and in a manner correlated with one another, for a form-locking connection of an at least partial support of the underside of a printed product loaded into the module by the upper side of a first carrier element of the first carrier element train and by the upper side of a second carrier element of the second carrier element train. Furthermore, the upper side of the loaded printed product has a form-locking connecting contact made therewith by the underside of a third carrier element of the first carrier element train and by the underside of a fourth carrier element of the second carrier element train, so that the underside of the printed product is held down on the upper sides of the first and the second carrier elements.

The flat printed products are advantageously retained in separated or singled form in the module. The thus retained printed products can be flat between the carrier elements or can have a dish shape and a preferably slight curvature, respectively. Expressed in other words, the distance between the first transport element and the second transport element can either be greater or equal, or alternatively thereto, smaller. Due to the curvature, a restoring force can be produced on the retained printed products, the force, respectively, being directed to the transport elements. The printed products are then held in position by a clamping action. Unique identification by assigning a carrier element of a carrier element train to a flat printed part is optionally possible, an advantage which is of great significance in particular for personalized printed products. According to the invention, the module is constructed so that loading of the module from the underside of the module and unloading of the module from the top of the module, or loading from the top and unloading from the underside is possible.

Expressed in another way, a first flat printed product picked up chronologically before a second flat printed product can be unloaded or removed again chronologically before the picked-up second flat printed product.

In an advantageous embodiment of the invention, the undersides of the third and of the fourth carrier element, as they hold down, exert a force on the loaded printed product in such a way that the latter is respectively gripped by the first and the third carrier elements and by the second and the fourth carrier elements. Expressed in other words, the upper side of the first carrier element and the underside of the third element, both of the first carrier element train, and the upper side of the second carrier element and the underside of the fourth carrier element, both of the second carrier element train, form respectively cooperating surfaces between which at least lateral sections, respectively, close to one edge of a flat printed product can be picked up, held fast or firmly or fixed. By the upper sides and undersides, respectively, of the carrier elements, a frictional force can also be exerted on the surfaces of the loaded printed product. In other words, the force can have components perpendicular to the surface and/or parallel to the surface of the loaded printed products.

In a preferred embodiment of the module according to the invention, the first and the second transport element, respectively, are formed by the belt part, and the associated carrier elements are formed by the teeth of a first and a second toothed belt. Provision is made for the toothed belts to be at least approximately identical in terms of the length and the tooth pitch thereof, in the number, the size and the shape of the teeth. In this case, the tooth flanks or sides can preferably be at least approximately parallel to one another. Furthermore, they can run at least approximately perpendicularly to the belt. If an angle differing from 90 degrees between tooth flanks and belt is provided, then slight angular differences from 90 degrees are preferred. Furthermore, it is also possible for the tooth flanks to follow a linear or nonlinear curve towards the tip of the teeth.

In the preferred embodiment of the module for temporary storage of a succession of flat printed products, the first toothed belt can loop or wrap partly around a first and a second deflection roller, and the second toothed belt can loop or wrap partly around a third and a fourth deflection roller, the paths of the toothed belts, at least in some sections, running at least approximately parallel to one another and at least approximately parallel to the side walls. The teeth of the toothed belts then lie on the side facing away from the deflection rollers, i.e., outside the closed paths formed by the toothed belts. Provision is made for a tooth of the first toothed belt (a first phase point) and a tooth of the second toothed belt (a second phase point) to be associated with one another, in particular, for the upper side of a tooth of the first toothed belt and the upper side of a tooth of the second toothed belt to be associated with or assigned to one another. The movement of the toothed belt, in particular the movement of the teeth held on the belt, can be carried out in a correlated manner.

In a further development of the module according to the invention, provision is made for the movements of the first and the second carrier element trains to be self-locking. Expressed in another way, the force exerted by the weight of the loaded printed products on the carrier element trains is compensated for by a suitable device, for example, by fixing or blocking the transport elements in order to avoid movement so that the loaded printed products are not thrown out of the module according to the invention at the underside thereof.

It is advantageous, and provision has been made in a further development of the advantageous embodiment of the invention, for the distance of the first to the second deflection roller, around which the first toothed belt loops or wraps, and the distance between the third and fourth deflection roller, around which the second toothed belt loops or wraps, to be variable in a manner correlating with one another, at least in the direction of the sectional parallel course of the toothed belts. Depending upon the elasticity of the toothed belt, a prestressing can be applied in the direction of the belt course and/or the distances of the teeth from one another, the pitch of the toothed belt, can be varied.

In the module according to the invention for temporary storage of a succession of flat printed products, provision is further made for the distance of the first to the second side wall to be variable. The assignment of the first carrier element train to the first side wall and of the second carrier element train to the second side wall implies that the distance of the first carrier element train to the second train and, in the preferred embodiment, of the first toothed belt to the second belt, respectively, can also be varied. Advantageously, by varying this distance, the module can be set or adapted to accommodate flat printed products of various widths.

Furthermore, at least one actuator can be provided in the module according to the invention in order to produce the relative movement between the transport elements and the side walls. For example, in the advantageous embodiment of the invention, the actuator is an electric motor which, by a suitable mechanical transfer of torque, drives one or more shafts of the deflection rollers, so that the toothed belts are moved along the paths thereof. Automatic loading and unloading of the module can be carried out advantageously.

In a further advantageous development of the module according to the invention, without loaded printed products, the distance of the first side wall to the second side wall can be reduced in such a way that at least one partial surface of the first side wall can be brought into form-locking engagement with the second side wall and/or the teeth of the first toothed belt can be brought into form-locking engagement with the teeth of the second toothed belt. As a result of bringing the first side wall into contact with the second side wall and the teeth of the two toothed belts into contact with one another, respectively, the unloaded module becomes a compact unit, which saves space for storage and/or transport. Furthermore, the modules can be provided with a code for identification, so that simple and fault-preventing assignment of the modules can be carried out for the further processing processes.

The module according to the invention can, on the one hand, be realized or implemented as a transportable or mobile unit which can be moved from a first location to a second location and which, therefore, advantageously permits simple interchange of flat printed products between print shops, further processing companies and/or within a company. On the other hand, the module according to the invention can also form a part of a feeder for a printed product further processing device, i.e., for machines in further print processing, such as book-binding machines, stapling machines, gatherer-stitchers, adhesive binders, thread-sealing machines, folders, mailroom machines, cutting machines, mailroom systems and the like. Furthermore, the module according to the invention can be constructed as a fixed or stationary module on a feeder, i.e., can be provided with a first geometric interface in such a way that a mobile module which has a complementary second geometric interface corresponding to the first geometric interface can be accommodated, at least for a time interval, so that the flat printed products accommodated in the mobile module can be unloaded successively and loaded successively into the stationary module. Expressed in other words, it is possible for metered feeding of the flat printed products into the feeder of the printed product further processing device to be performed. The fixed module can also be designated as an intermediate module. By providing the module according to the invention, a system is made available which advantageously links stationary and mobile storage of flat printed products.

By the module according to the invention, wastage arising from improper transport and/or storage, in particular from varying the orientation of the module, is avoided.

Other features which are considered as characteristic for the invention are set forth in the appended claims.

Although the invention is illustrated and described herein as embodied in a module for temporarily storing flat printed products and a printed product further processing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
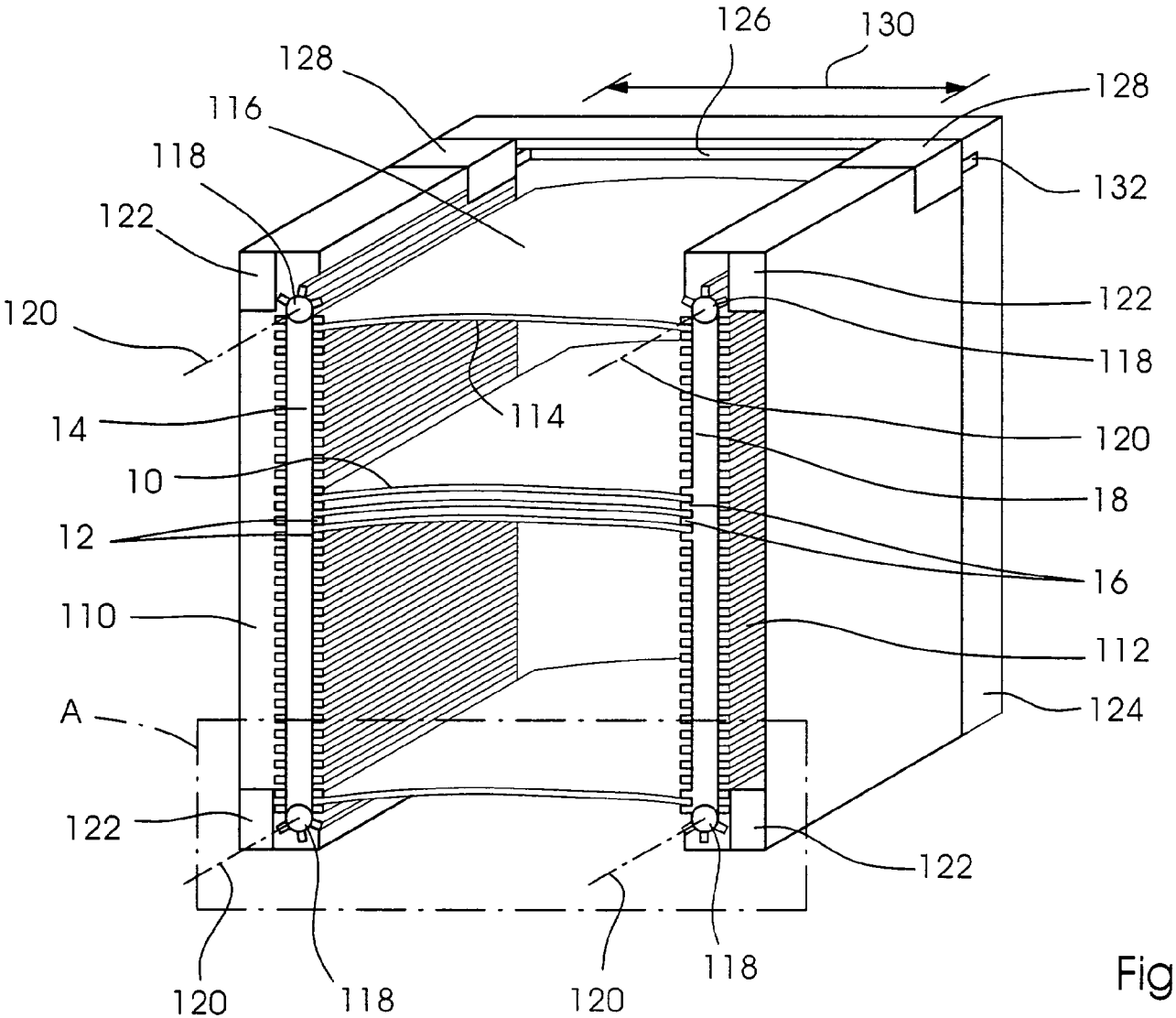
FIG. 1 is a diagrammatic, front, top and side perspective view of a preferred embodiment of the module according to the invention for temporarily storing a succession of printed products.

Referring now to the figures of the drawings in detail and first, particularly, to FIG. 1 thereof, there is diagrammatically shown therein a preferred embodiment of a module according to the invention for temporarily storing a succession of printed products. In this embodiment of the module according to the invention, there is shown a succession of flat printed products 10 held, with a slight curvature, concave on an underside 114 thereof and convex on an upper side 116 thereof, the embodiment of the module being formed with a first side wall 110 with a first carrier element train 12 on a first transport element 14, and a second side wall 112 with a second carrier element train 16 on a second transport element 18. The first carrier element train 12 on the first transport element 14 is formed by teeth on a belt of a thus formed toothed belt. This is correspondingly true for the second carrier element train 16 on the second transport element 18. In the embodiment shown in FIG. 1, the toothed belts, respectively, run around two deflection rollers 118, which are rotatable about rotational axes 120 thereof, so that the toothed belts or the transport elements 14, 18 with the carrier element trains 12, 16 can run around the deflection rollers 118 on the paths thereof. With the exception of sections along the deflection rollers 118, the paths of the transport elements 14, 18 extend at least approximately parallel to the first and second side walls 110 and 112. In this exemplary embodiment, four transport element drives 122 assigned to the deflection rollers 118 are provided by way of example. The first and the second transport elements 14 and 18 can run in a correlated manner in mutually different directions of rotation, so that on the parallel, inner path, the first carrier element train 16 and the second carrier element train 18 execute a parallel, identically directed and correlated movement.

In this embodiment, the first and the second side walls 110 and 112 are connected to one another by a transverse wall 124. A corresponding transverse wall on the front side of the module according to the invention is not illustrated in FIG. 1, in order to be able to show internal details. As an alternative thereto, it is possible to provide a different suitable connection for ensuring adequate parallelism of the transport element paths and for fixing the module, for example, rods, frames or the like may be used. By way of example, the transverse wall is formed with a guide cutout 126, so that the side walls 110 and 112 with a guide molding or profile 132 thereof, which are brought into a form-locking connection with the guide cutout 126, undergo positional fixing. Actuators 128 are provided for varying the spacing 130 between the side walls 110 and 112. The first and the second side wall 110 and 112 can therefore be moved towards one another or away from one another, viewed in relative terms, so that a format adjustment can be realized.

Examples of dimensions for the module according to the invention are, for an embodiment as shown in FIG. 1: thickness of the side walls 110 and 112 from 20 mm to 30 mm, preferably 25 mm; height of the module from 800 mm to 1200 mm, preferably 1000 mm; width of the side walls 110 and 112 from 280 mm to 360 mm, preferably 320 mm. It is believed to be clear, however, to those skilled in the art that modules according to the invention can expediently have at least approximately different dimensions, in order, for example, to be able to accommodate printed products in postcard formats, standard dimensions of German Industry Dimensions (DIN) or the like. A detail A of FIG. 1 relates to the lower part of the module according to the invention, with a respective deflection roller 118 in each side wall 110 and 112.

Figure 2:
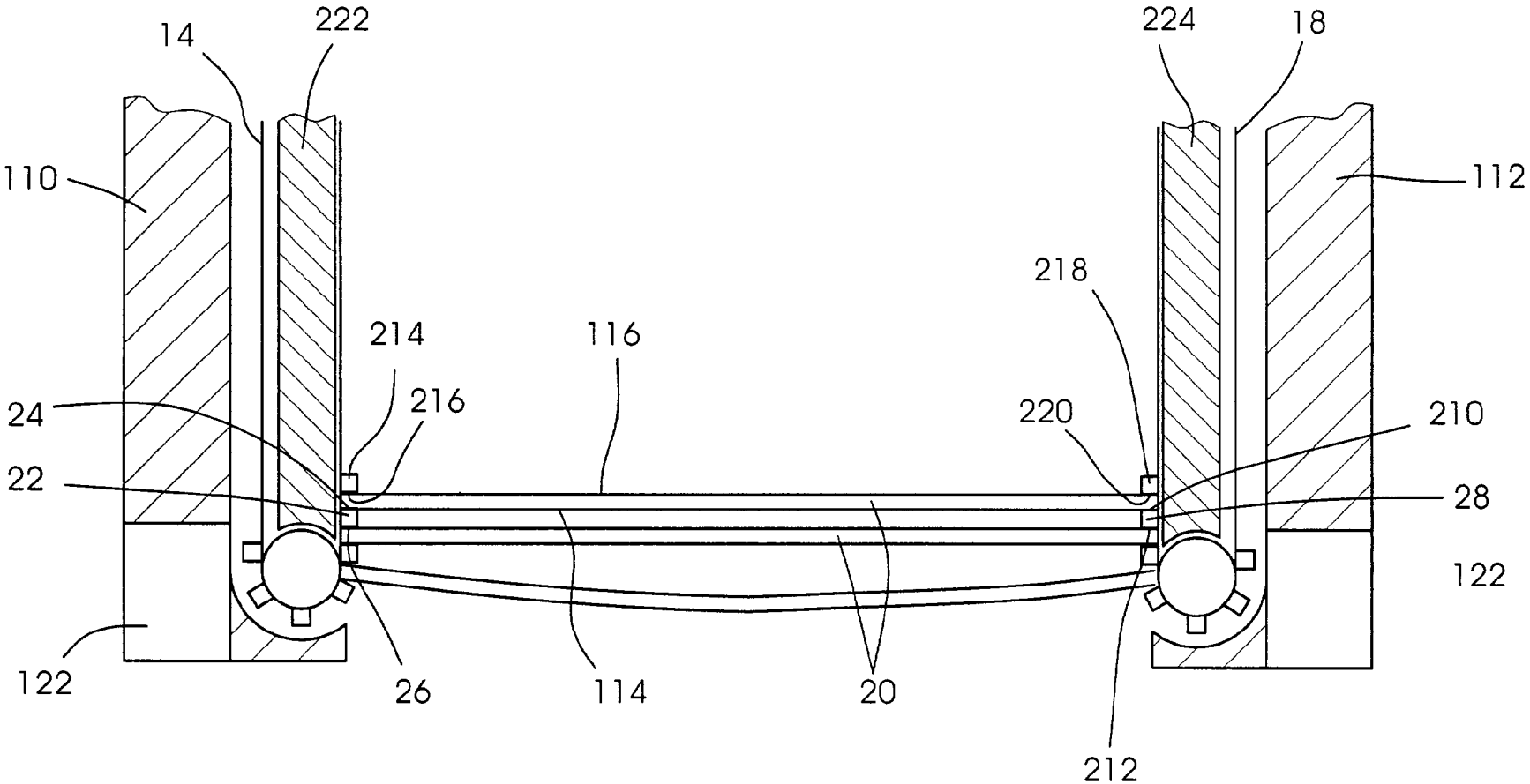
FIG. 2 is an enlarged, fragmentary, sectional view of FIG. 1 showing a portion thereof contained within a region A.

FIG. 2 is an enlarged diagrammatic view of the detail A of FIG. 1 and shows the lower deflection rollers 118, around which, respectively, the path of the first transport element 14 with the first carrier element train 12 runs in the first side wall 110, and the path of the second transport element 18 with the second carrier element train 16 runs in the second side wall 112. On the path curved around the deflection roller 118, the individual carrier elements on the side facing away from the deflection roller 118 are spread apart and, simultaneously, sections of the first transport element 14 and sections of the second transport element 18, which are correlated with one another, are removed farther from one another than correlated sections of both transport elements 14 and 18 when the paths of the two transport elements 14 and 18 run at least approximately parallel to one another. These facts can be utilized for respectively loading and unloading the module according to the invention. A loaded printed product 20 is supported at the underside 114 thereof between the first transport element 14 and the second transport element 18 by an upper side 24 of a first carrier element 22 and by an upper side 210 of a second carrier element 28, while the loaded printed product 20 is held down at an upper side 116 thereof by an underside 216 of a third carrier element 214 and by an underside 220 of a fourth carrier element 218. On the curved paths around the deflection rollers 118, for the purpose of loading, the respective printed product 20 can be fed between the transport elements and the carrier elements from below by a transport device, not shown here, and, respectively, the printed product 20 is released for the purpose of unloading, because the carrier elements spread apart from one another on the side facing away from the deflection roller 118, while correlated sections of the first and of the second transport elements 14 and 18, respectively, move away from one another. Analogous conditions prevail at the upper side of the module according to the invention; here, loading and unloading, respectively, of the printed products 20 can be performed in an analogous manner. The path of the first transport element 14 is looped around a supporting surface 222 of the first side wall 110. This can prevent movement of the first transport element 14 in a direction perpendicular to the course of the parallel path of the two transport elements 14 and 18, so that the flat printed products are prevented from slipping out of the first carrier element train 16. In a corresponding manner, a supporting surface 224 is provided in the second side wall 112, around which the path of the second transport element 16 is looped.

Figure 3:
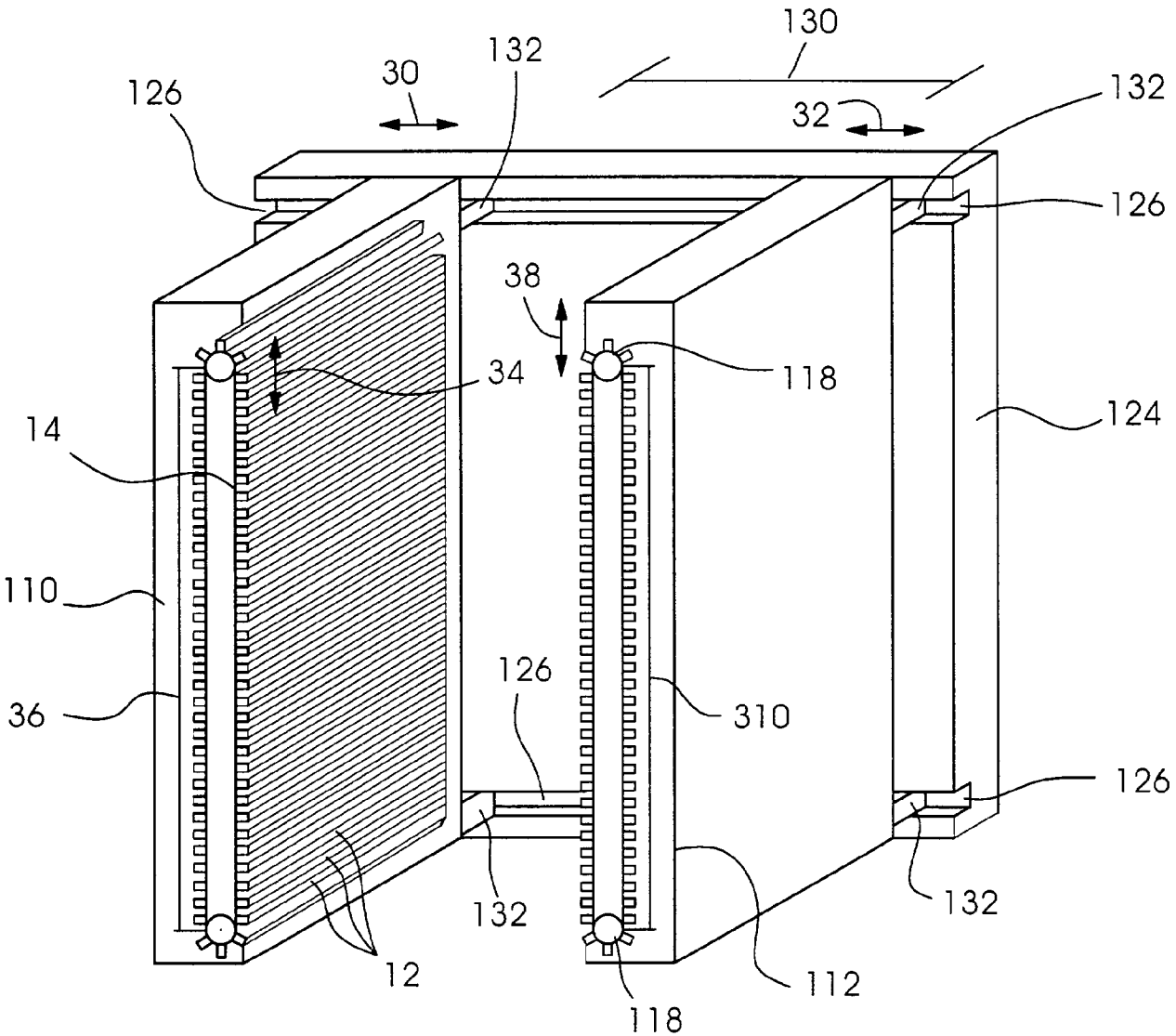
FIG. 3 is another front, top and side perspective view of an embodiment of the module according to the invention for explaining how the spaced distance between the side walls is varied.

FIG. 3 relates diagrammatically to a possible embodiment of the module according to the invention for explaining the variation in the spacing or distance between the side walls 110 and 112. Shown in the first side wall 110 are deflection rollers 118 which are spaced a distance 36 apart. By way of example, in this embodiment the upper transport element drive 122 (note FIG. 1) is constructed so that, in addition to the rotational movement of the upper deflection roller 118, a change 34 in the position of the upper deflection roller 118 can also be performed at least in the direction of the parallel course of the transport elements 14 and 18. On the one hand, the first transport elements 14 with the first carrier element train 12 can consequently be tautened or tensioned on the path thereof around the deflection rollers 118 and, on the other hand, a simpler and more convenient construction and installation, respectively, of the transport element 14 can be performed for a small distance 36. Deflection rollers 118 at a spaced distance 310 are shown in a corresponding way in the second side wall 112. In a manner analogous to the first side wall 110, the upper transport element drive 122 in the second side wall 112 is also constructed so that, in addition to the rotational movement of the upper deflection roller 118, a change in the position 38 of the upper deflection roller 118 can also be performed, at least in the direction of the parallel course of the transport elements 14 and 18. The position of the deflection rollers 118 relative to one another is correlated. Expressed in other words, the section on which the paths of the first and second transport elements 14 and 18 run at least approximately parallel and opposite one another on the inner sides of the first and second side walls 110 and 112 determines the distance 36 between the deflection rollers 118 in the first side wall 110 and the distance 310 between the deflection rollers 118 in the second side wall 112. For the application or use of the module according to the invention, the distance 36 and the distance 310 are virtually the same.

The preferred embodiment for the first and second transport elements 14 and 18, respectively, with the first and the second carrier element trains 12 and 16, respectively, is again, respectively, a toothed belt. FIG. 3 shows diagrammatically an advantageous modification of this embodiment. In the first side wall 110, the toothed belt is shown extending two-dimensionally over a large part of the width of the side wall, i.e., along a direction from one transverse wall to the other transverse wall. Provision is made for the width of the toothed belt to correspond to at least or greater than that of a maximum length of a flat printed product to be loaded into the module. Alternatively thereto, a number of toothed belts of lesser width which, not necessarily, but preferably have the same width and have paths running at least approximately parallel, can be provided in at least one of the side walls 110 and 112. In this alternative embodiment, the toothed belt positions (phase points, positions of the teeth) must be correlated with one another in the same phase in order that a flat printed product can be loaded without changing the shape thereof.

Based upon the embodiment shown in FIG. 3, the setting of the format or the ability to set the format of the module according to the invention is also explained hereinafter. The rear transverse wall 124 is formed with a guide cutout 126, respectively, in the vicinity of the upper end thereof and in the vicinity of the lower end thereof. Associated therewith these are guide profilings or moldings 132 on the first and the second side walls 110 and 112, respectively, so that stability is imparted to the module according to the invention, and a variation in the spaced distance 130 between the first and the second side walls 110 and 112 can be performed. Further guides in addition to two in number can also be provided as an alternative. Guide cutouts can also be located at the ends of the side walls 110 and 112, and assigned to guide profilings on the transverse wall 124. The preferred embodiment here includes elements, not shown in the drawing, for fixing the spaced distance 130, for example clamping elements, closures, screws, bolts or the like. An actuator mechanism for automatically setting the distance 130 may optionally be provided. A change in the spaced distance is preferably performed by a symmetrical movement of both side walls 110 and 112.

Figure 4B:
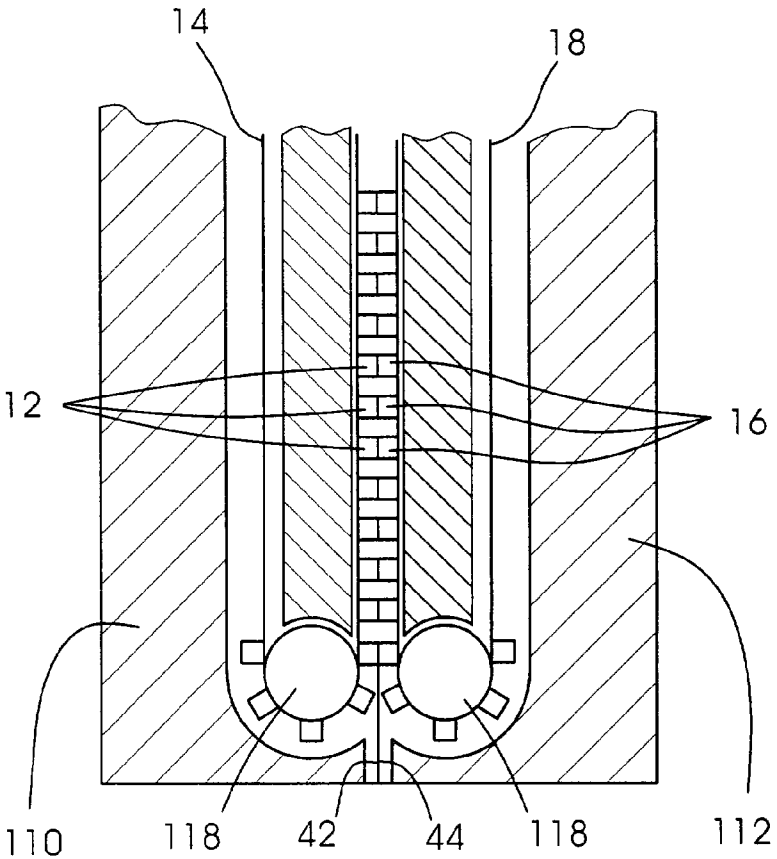
FIG. 4B is an enlarged, fragmentary, sectional view of FIG. 4A showing a portion thereof contained within a region V.
Figure 4A:
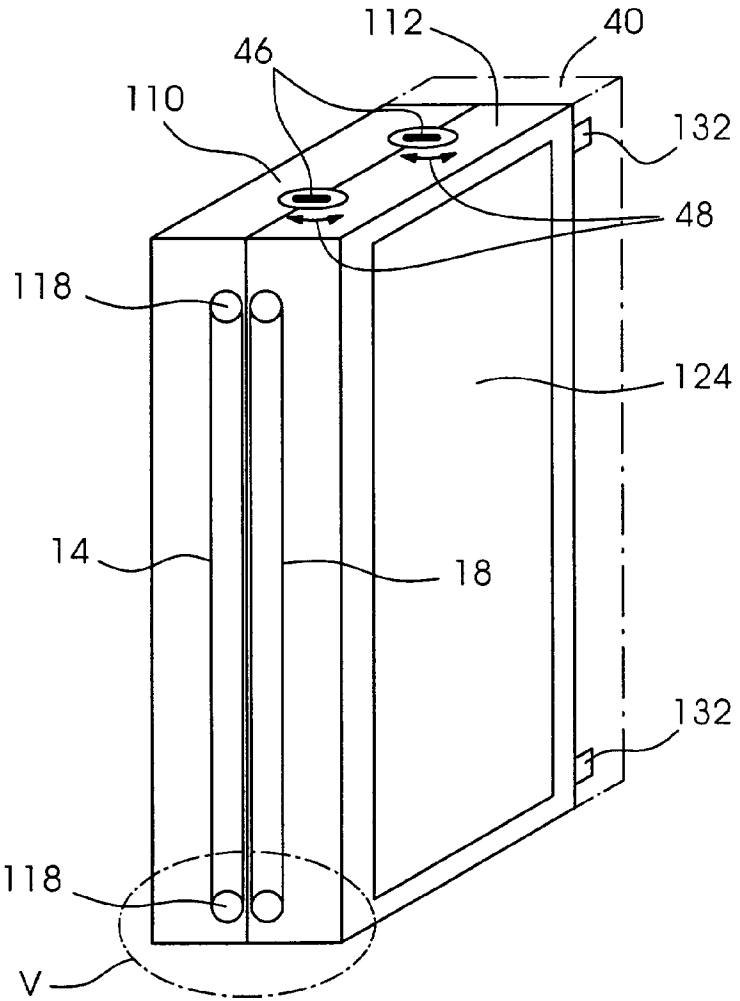
FIG. 4A is a front, top and side perspective view of an empty module according to the invention with lockable side walls pushed together and an optional narrow transverse wall.

FIGS. 4A and 4B are diagrammatic views of an empty module according to the invention with pushed-together, lockable side walls and with an optional transverse wall. In FIG. 4A, the first side wall 110 with the first transport element 14 looped or wrapped around the deflection rollers 118, and the second side wall 112 with the second transport element 18 looped or wrapped around the deflection rollers 118 have been moved close to one another so that a compact block is formed. In the embodiment shown, provision is made for the wide transverse wall 124 of the embodiment of FIG. 3 to be removable by guide cutouts 126 preferably extending as far as the end faces thereof, so that, instead of the wide wall 124, a narrow transverse wall 40, wherein the guide profilings 123 for maintaining the stability of the module can be made, can be fitted to an empty, pushed-together module. As an alternative thereto, provision can be made for the side walls 110 and 112 to be capable of being held together in the close position thereof by a clamp-like connection, clamping elements, screws, bolts or the like. In FIG. 4A, a conventional locking element 46 is shown by way of example. As a result of a rotation in the direction of movement 48, a connection between the pushed-together first and second side walls 110 and 112 can be made: In a first position of the locking element 46, the side walls 110 and 112 are fixed to one another, in a second position the side walls are movable with respect to one another. Furthermore, provision can be made for the wide transverse wall 124 to be integrated or accommodated in a recess formed in the side wall, here the second side wall 112, when the empty module is in the pushed-together condition.

FIG. 4B shows an enlarged detail V of the diagrammatic illustration of FIG. 4A. The lower region of the pushed-together side walls 110 and 112 is thus shown in FIG. 4B. A partial surface 42 of the first side wall 110 rests on a partial surface 44 of the second side wall 112. Provision is preferably made for partial surfaces of this type to rest on one another on the front and rear edges of the side walls 110 and 112. For the upper side and the underside, which represent the two loading and unloading sides, respectively, provision can advantageously be made for the side walls 110 and 112 to be taken out easily, so that simple loading of the first and of the second carrier element trains 12 and 16, respectively, on the deflection rollers 118 can be performed when the module according to the invention is moved apart so as to be ready for use. FIG. 4B further illustrates that, in the pushed-together module, the first and the second carrier element trains 12 and 16 rest on one another at the ends thereof.

Both the modules in use format and the modules in empty transport format can be placed on a tray formed with a base surface having four side walls at least approximately perpendicular thereto, the side walls being of low height in comparison with the dimensions of the base surface. This tray, whether formed of a metallic or wooden material or of a plastic material, can also be referred to as a pallet. A tray can be constructed to hold one module or to hold a number of modules, typically twelve modules. A cover corresponding to the tray can be slipped over the upper side of the module or modules. Particularly advantageous are trays which have a suitable format for a number of full modules but which can also hold empty, pushed-together modules. Provision can be made for a possibility of joining the trays and the modules to one another.

Figure 5B:
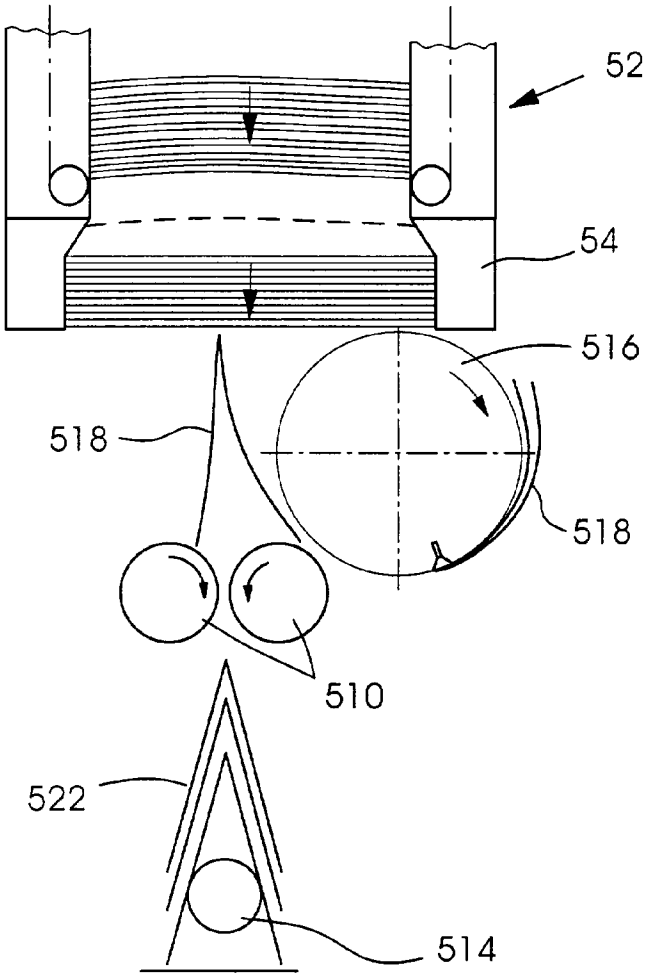
FIG. 5B is a view similar to that of FIG. 5A of a feeder having a stationary module according to the invention provided, however, for a gatherer-stitcher.
Figure 5A:
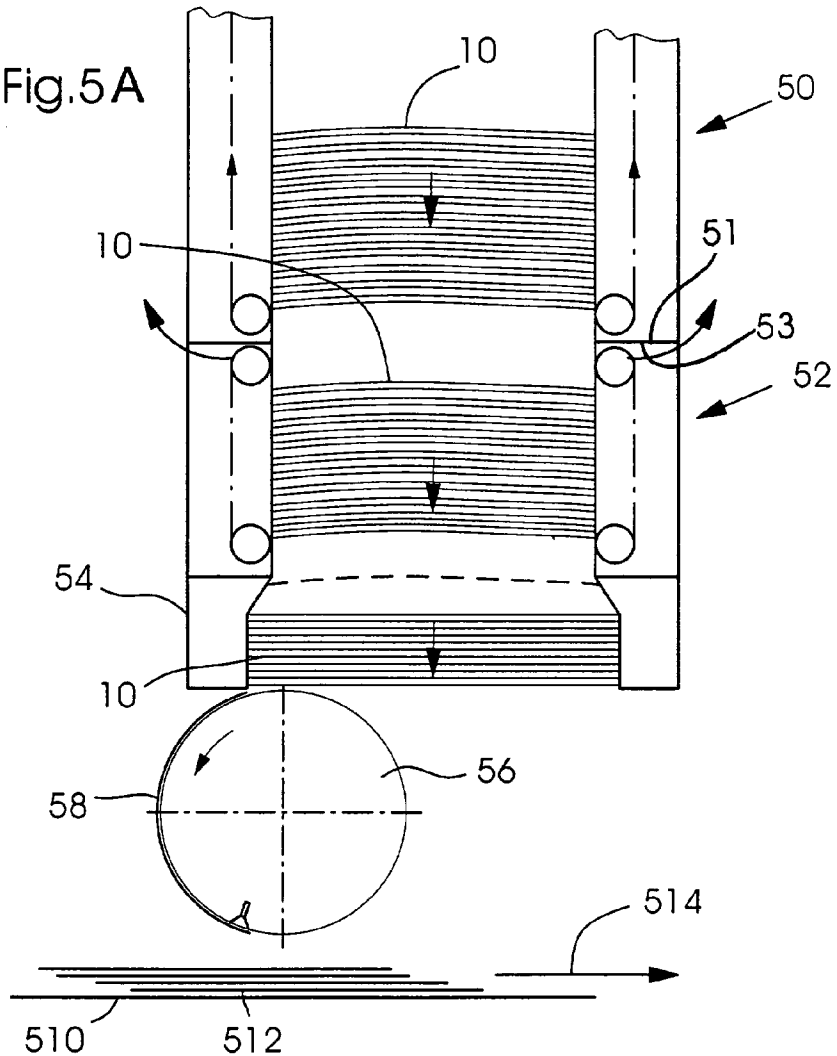
FIG. 5A is a side-elevational view of a feeder having a stationary module according to the invention for an adhesive binder.
Figure 5C:
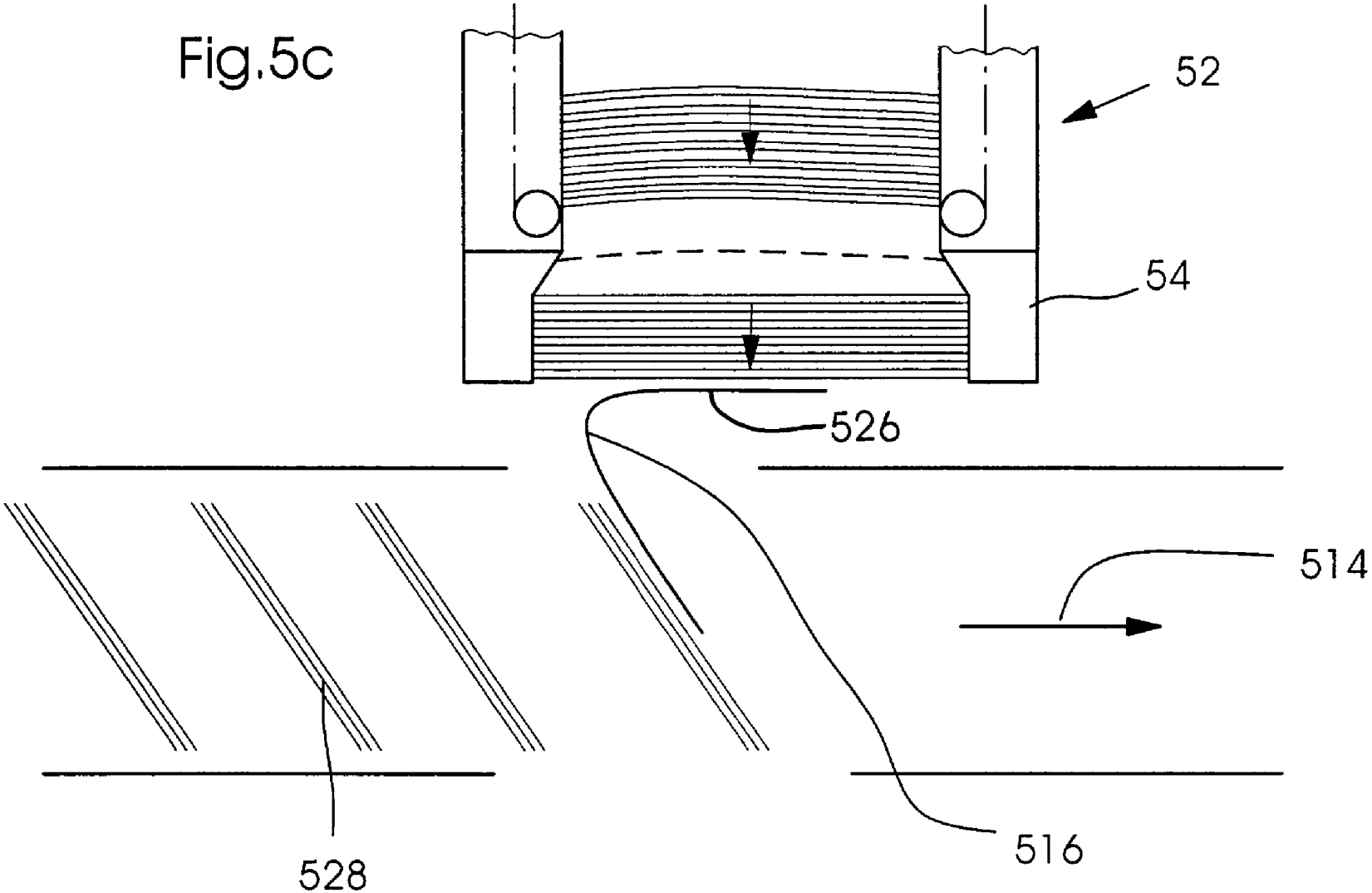
FIG. 5C is a view similar to those of FIGS. 5A and 5B of a feeder having a stationary module according to the invention provided, however, for a binder machine.

FIGS. 5A, 5B and 5C, by way of example, show the application or use of a feeder for a printed product processing unit equipped with a stationary module according to the invention, whereon a mobile module according to the invention can be accommodated. Alternatively to those shown, other printed product processing units can also be provided with stationary modules.

FIG. 5A is a diagrammatic view of a feeder with, according to the invention, a stationary module 52 for an adhesive binder. The stationary module 52 provides, via interfaces 53, consequently, geometric profiling or shaping for aligning the position and also possibly for fixing, to which interfaces 51 of the mobile module 50 according to the invention, which are complementary to those of the stationary module 52, can be fitted. Flat printed products 10 can then be transferred in the direction of the respective arrow from the mobile module 50 into the stationary module 52 for temporary storage. From the latter, they pass into the feeder 54 and ultimately to the separating device 56 which, by a rotational movement, deposits separated, printed products 58 or separated packs of printed products, not shown here, on a transport device 510. Collected flat printed products 512 are guided in the transport direction represented by the arrow 514 to a gluing device.

FIG. 5B illustrates diagrammatically a feeder of a gatherer-stitcher having a stationary module 52 according to the invention. Loaded from a mobile module 50, for example, corresponding to that of FIG. 5A, a succession of flat printed products 10, which are signatures folded at least once, can be transferred from the stationary module 52 into the feeder 54. By the rotational movement of the separating device 516, separated flat printed products 518 are removed from the succession of flat printed products. They pass between opening rollers 510 and are deposited on the transport device 514 of the gatherer-stitcher astride the length of the fold, so that straddlingly gathered printed products 522 are transported along the gathering chain 524, here in a direction perpendicular to the plane of the paper.

FIG. 5C is a diagrammatic view of a feeder 54 having a stationary module 52 for a binding machine. From the feeder 54, a separated flat printed product 526, for example, a cover sheet, is placed on a block of printed products 528, which pass through the feeder in succession in the transport direction 514.

At this point, it should further be noted that loading a conventional feeder, if appropriately provided with suitable interfaces, stops, guides, fixing devices and the like, can be performed, also, directly from a mobile module according to the invention. It should be emphasized again that loading the mobile module can be performed from one side, for example, the underside thereof, and unloading the mobile module can be performed on the other side, the previous upper side thereof, but now the underside thereof, due to a rotation through 180 degrees about an horizontally extending axis. Because the flat printed products are fixed in the position thereof in the module according to the invention, the module can also be inserted at angles which differ from zero degrees with respect to the vertical.

I claim:

1. A module for temporarily storing a succession of flat printed products, comprising:

first and second mutually opposite side walls spaced apart by a variable distance;

first and second transport elements respectively assigned to said first and second side walls;

first and second carrier element trains respectively disposed on said first and second transport elements, said first carrier element train having a first carrier element with an upper side and a third carrier element with a underside, said second carrier element train having a second carrier element with an upper side and a fourth carrier element with a underside; and means for curving a loaded printed product, said means adjusting the distance between said first and second side walls causing the loaded printed product to be held with a curvature, concave on an underside thereof and convex on an upper side thereof;

said transport elements being movable relative to said side walls and correlated with one another, for a form-locking, at least partial support of the underside of the loaded printed product by said upper sides of said first and second carrier elements;

said undersides of said third and said fourth carrier elements making form-locking contact with the upper side of the loaded printed product, for holding down the underside of the loaded printed product on said upper sides of said first and said second carrier elements.

2. The module according to claim 1, wherein said undersides of said third and said fourth carrier elements holding down the loaded printed product exert a force on the loaded printed product causing the latter to be respectively gripped by said first and said third carrier elements and by said second and said fourth carrier elements.

3. The module according to claim 1, wherein said first and second transport elements are respective first and a second toothed belts, and said carrier elements are teeth of said first and second toothed belts.

4. The module according to claim 3, further comprising first, second, third and fourth deflection rollers, said first toothed belt partly surrounding said first and second deflection rollers and said second toothed belt partly surrounding said third and fourth deflection rollers, said toothed belts having paths running, at least in some sections thereof, at least approximately parallel to one another and at least approximately parallel to said side walls.

5. The module according to claim 4, wherein said first and second deflection rollers are spaced apart by a distance, said third and fourth deflection rollers are spaced apart by a distance, and said distances are variable in correlation with one another in a direction of a sectional parallel course of said toothed belts.

6. The module according to claim 1, further comprising at least one actuator for producing relative movement between said transport elements and said side walls.

7. The module according to claim 1, wherein said first and second side walls have partial surfaces, and said variable distance between said first and second side walls is to be reduced, without any printed products loaded in the module, for bringing at least one of said partial surfaces of said first side wall into form-locking engagement with one of said partial surfaces of said second side wall.

8. The module according to claim 3, wherein said variable distance between said first and second side walls is to be reduced, without any printed products loaded in the module, for bringing said teeth of said first toothed belt into form-locking engagement with said teeth of said second toothed belt.

9. The module according to claim 3, wherein said first and second side walls have partial surfaces, and said variable distance between said first and second side walls is to be reduced, without any printed products loaded in the module, for bringing at least one of said partial surfaces of said first side wall into form-locking engagement with one of said partial surfaces of said second side wall and for brining said teeth of said first toothed belt into form-locking engagement with said teeth of said second toothed belt.

10. A printed product further processing device, comprising a feeder having a module for temporarily storing a succession of flat printed products, the module including:

first and second mutually opposite side walls spaced apart by a variable distance;

first and second transport elements respectively assigned to said first and second side walls;

first and second carrier element trains respectively disposed on said first and second transport elements, said first carrier element train having a first carrier element with an upper side and a third carrier element with a underside, said second carrier element train having a second carrier element with an upper side and a fourth carrier element with a underside; and means for curving a loaded printed product, said means adjusting the distance between said first and second side walls causing the loaded printed product to be held with a curvature, concave on an underside thereof and convex on an upper side thereof;

said transport elements being movable relative to said side walls and correlated with one another, for a form-locking, at least partial support of the underside of the loaded printed product by said upper sides of said first and second carrier elements;

said undersides of said third and said fourth carrier elements making form-locking contact with the upper side of the loaded printed product, for holding down the underside of the loaded printed product on said upper sides of said first and said second carrier elements.

11. A gatherer-stitcher, comprising a feeder having a module for temporarily storing a succession of flat printed products, the module including:

first and second mutually opposite side walls spaced apart by a variable distance;

first and second transport elements respectively assigned to said first and second side walls;

first and second carrier element trains respectively disposed on said first and second transport elements said first carrier element train having a first carrier element with an upper side and a third carrier element with a underside, said second carrier element train having a second carrier element with an upper side and a fourth carrier element with a underside; and means for curving a loaded printed product, said means adjusting the distance between said first and second side walls causing the loaded printed product to be held with a curvature, concave on an underside thereof and convex on an upper side thereof;

said transport elements being movable relative to said side walls and correlated with one another, for a form-locking, at least partial support of the underside of the loaded printed product by said upper sides of said first and second carrier elements;

said undersides of said third and said fourth carrier elements making form-locking contact with the upper side of the loaded printed product, for holding down the underside of the loaded printed product on said upper sides of said first and said second carrier elements.

12. An adhesive binder, comprising a feeder having a module for temporarily storing a succession of flat printed products, the module including:

first and second mutually opposite side walls spaced apart by a variable distance;

first and second transport elements respectively assigned to said first and second side walls;

first and second carrier element trains respectively disposed on said first and second transport elements, said first carrier element train having a first carrier element with an upper side and a third carrier element with a underside, said second carrier element train having a second carrier element with an upper side and a fourth carrier element with a underside; and means for curving a loaded printed product, said means adjusting the distance between said first and second side walls causing the loaded printed product to be held with a curvature, concave on an underside thereof and convex on an upper side thereof;

said transport elements being movable relative to said side walls and correlated with one another, for a form-locking, at least partial support of the underside of the loaded printed product by said upper sides of said first and second carrier elements;

said undersides of said third and said fourth carrier elements making form-locking contact with the upper side of the loaded printed product, for holding down the underside of the loaded printed product on said upper sides of said first and said second carrier elements.

13. A thread-sealing machine, comprising a feeder having a module for temporarily storing a succession of flat printed products, the module including:

first and second mutually opposite side walls spaced apart by a variable distance;

first and second transport elements respectively assigned to said first and second side walls;

first and second carrier element trains respectively disposed on said first and second transport elements, said first carrier element train having a first carrier element with an upper side and a third carrier element with a underside, said second carrier element train having a second carrier element with an upper side and a fourth carrier element with a underside; and means for curving a loaded printed product, said means adjusting the distance between said first and second side walls causing the loaded printed product to be held with a curvature, concave on an underside thereof and convex on an upper side thereof;

said transport elements being movable relative to said side walls and correlated with one another, for a form-locking, at least partial support of the underside of the loaded printed product by said upper sides of said first and second carrier elements;

said undersides of said third and said fourth carrier elements making form-locking contact with the upper side of the loaded printed product, for holding down the underside of the loaded printed product on said upper sides of said first and said second carrier elements.

14. A folder, comprising a feeder having a module for temporarily storing a succession of flat printed products, the module including:

first and second mutually opposite side walls spaced apart by a variable distance;

first and second transport elements respectively assigned to said first and second side walls;

first and second carrier element trains respectively disposed on said first and second transport elements, said first carrier element train having a first carrier element with an upper side and a third carrier element with a underside, said second carrier element train having a second carrier element with an upper side and a fourth carrier element with a underside; and means for curving a loaded printed product, said means adjusting the distance between said first and second side walls causing the loaded printed product to be held with a curvature, concave on an underside thereof and convex on an upper side thereof;

said transport elements being movable relative to said side walls and correlated with one another, for a form-locking, at least partial support of the underside of the loaded printed product by said upper sides of said first and second carrier elements;

said undersides of said third and said fourth carrier elements making form-locking contact with the upper side of the loaded printed product, for holding down the underside of the loaded printed product on said upper sides of said first and said second carrier elements.

15. A mailroom system, comprising a feeder having a module for temporarily storing a succession of flat printed products, the module including:

first and second mutually opposite side walls spaced apart by a variable distance;

first and second transport elements respectively assigned to said first and second side walls;

first and second carrier element trains respectively disposed on said first and second transport elements, said first carrier element train having a first carrier element with an upper side and a third carrier element with a underside, said second carrier element train having a second carrier element with an upper side and a fourth carrier element with a underside; and means for curving a loaded printed product, said means adjusting the distance between said first and second side walls causing the loaded printed product to be held with a curvature, concave on an underside thereof and convex on an upper side thereof;

said transport elements being movable relative to said side walls and correlated with one another, for a form-locking, at least partial support of the underside of the loaded printed product by said upper sides of said first and second carrier elements;

said undersides of said third and said fourth carrier elements making form-locking contact with the upper side of the loaded printed product, for holding down the underside of the loaded printed product on said upper sides of said first and said second carrier elements.

* * * * *